United States Patent [19]

Stewart et al.

[11] 3,950,277

[45] Apr. 13, 1976

[54] LAUNDRY PRE-SOAK COMPOSITIONS

[75] Inventors: Robert Lee Stewart; Homer Wallace McCune, both of Cincinnati; Francis Louvaine Diehl, Wyoming, all of Ohio

[73] Assignee: The Procter & Gamble Company, Cincinnati, Ohio

[22] Filed: July 25, 1973

[21] Appl. No.: 382,415

[52] U.S. Cl. ..... 252/541; 8/137; 252/117; 252/121; 252/523; 252/527; 252/529; 252/539; 252/546; 252/548; 252/558; 252/DIG. 12

[51] Int. Cl.[2] ..... C11D 3/386; C11D 1/22

[58] Field of Search ..... 8/137, 139; 252/DIG. 12, 252/544, 548, 546, 558, 539, 545, 523, 541

[56] References Cited

UNITED STATES PATENTS

| | | | |
|---|---|---|---|
| 1,750,198 | 3/1930 | Schrauth | 252/558 |
| 1,881,745 | 10/1932 | Lindner | 8/139 X |
| 2,047,069 | 7/1936 | Hentrich et al. | 117/139.5 E |
| 3,451,935 | 6/1969 | Roald et al. | 252/135 |
| 3,553,139 | 1/1971 | McCarty | 252/95 |
| 3,655,568 | 4/1972 | Zaki et al. | 252/99 |
| 3,707,505 | 12/1972 | Maeda et al. | 252/136 |

FOREIGN PATENTS OR APPLICATIONS

| | | | |
|---|---|---|---|
| 1,156,238 | 6/1969 | United Kingdom | 252/DIG. 12 |

OTHER PUBLICATIONS

Wills, Article in Biochemical Journal, Vol. 60, 1955, pp. 529 to 534.

*Primary Examiner*—Herbert B. Guynn
*Attorney, Agent, or Firm*—Charles R. Wilson; Richard C. Witte; Thomas H. O'Flaherty

[57] ABSTRACT

Compositions and methods for removing oily triglyceride stains from fabrics employing a lipase enzyme and a lipase activator selected from the group consisting of naphthalene sulfonates, certain polyoxyalkylene derivatives of ethylenediamine and certain acylamino acid salts. The lipase-plus-activator compositions are utilized to pre-soak soiled fabrics, which are subsequently laundered using conventional household equipment.

6 Claims, No Drawings

LAUNDRY PRE-SOAK COMPOSITIONS

BACKGROUND OF THE INVENTION

This invention relates to compositions and methods for removing oily triglyceride stains from fabrics, especially cotton or cotton blend fabrics. More particularly, the invention relates to the use of mixtures of a lipase enzyme and an activator selected from the group consisting of naphthalene sulfonates, certain polyoxyalkylene derivatives of ethylenediamine and certain acylamino acid salts as pre-soaking compositions for removal of oily triglyceride stains.

Current laundry and pre-soak procedures exhibit one or more deficiencies when used to remove triglyceride stains. This is especially true in the case of hollow fibre polyester/cotton blend fabrics. Effective removal of such stains has been for the most part accomplished by means of inconvenient and expensive dry cleaning. Accordingly, an efficient, low cost process for the removal of oily triglyceride stains employing standard household laundering equipment is desirable.

The present invention employs the combination of a lipase enzyme and a lipase activator in a laundry pre-soak operation for the removal of oily triglyceride stains from fabrics. The use of lipolytic enzymes (i.e., lipases) in cleansing operations has been described in German Pat. No. 491,219; British Pat. No. 682,878; and U.S. Pat. No. 3,451,925. The co-pending applications of Storm, Ser. No. 315,031, filed Dec. 14, 1972 and Montgomery, Ser. No. 315,049, filed Dec. 14, 1972 both now abandoned disclose laundry pre-soaks containing lipase in combination with a divalent cation and/or borax salts to enhance lipase activity. The enhancing effect of natural bile salts on mixtures of lipases and surface active agents has been described by E. D. Wills, *Bio. Chem. J.*, 60, 529 (1955), "The Effect of Surface-Active Agents on Pancreatic Lipase". Although bile salts were shown to enhance lipase-pulse-detergent hydrolysis of triglycerides, biles salts are expensive and therefore commercially unattractive.

In the present invention, improved low cost removal of oily triglyceride stains from fabrics, especially cotton blends, is obtained by the use of a lipolytic enzyme (i.e., lipases) and a synthetic lipase activator. Such activators have been found to be effective and economical substitutes for the bile lipase activators.

It is an object herein to provide improved economical compositions and methods for the removal of triglyceride stains from fabrics.

It is another object herein to provide compositions and methods for the removal of triglyceride stains from fabrics utilizing standard household laundry equipment.

These and other objects are provided for herein as will be seen from the following disclosure.

SUMMARY OF THE INVENTION

The present invention encompasses laundry compositions especially adapted to removal of triglyceride stains from fabrics, comprising from about 0.01 to about 7.0% by weight of a lipolytic enzyme, and from about 0.1 to about 70.0% by weight of a lipase activator selected from the group consisting of water-soluble napthalene sulfonates; water-soluble (having a cloud point in 10% solution less than 75°C) polyoxyalkylene derivatives of ethylenediamine of the formula:

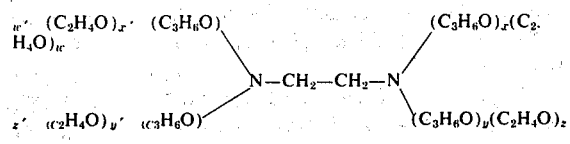

wherein, $x$, $y$, $x'$, and $y'$ are each integers having a sum of from about 8 to about 120 (preferably from about 25 to about 90) and $w$, $z$, $w'$, and $z'$ are each integers having a sum of from about 2 to about 80 (preferably from about 6 to about 65); and water-soluble acylamino acid salts of the formula:

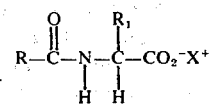

wherein R is straight or branched chain alkyl containing at least 9 carbon atoms (preferably containing from about 9 to about 26 carbon atoms), $R_1$ is a member selected from the group consisting of hydrogen, methyl, isopropyl, isobutyl, 1-methylpropyl, hydroxymethyl, and 1-hydroxyethyl, and $X^+$ is a cation such as alkali metal, ammonium, or substituted ammonium.

The compositions herein are particularly effective when used in pre-soaking processes wherein the soiled fabric is soaked in said aqueous compositions for a period of from at least about 30 minutes to about 24 hours, and thereafter laundered in an aqueous solution of a conventional soap or detergent composition using standard household equipment.

DETAILED DESCRIPTION OF THE INVENTION

The compositions of the present invention contain two essential components, a lipolytic enzyme (lipase) and a lipase activator. The lipase comprises from about 0.01 to about 7.0%, preferably from about 0.02 to about 4.0%, of the composition and the lipase activator comprises from about 0.1 to about 70.0%, preferably from about 0.2 to about 40.0%, by weight of the composition. Unless otherwise indicated, reference to % concentrations mean % by weight of the total composition.

The process of the present invention for removing triglyceride stains from fabrics involve two essential steps. The first step consists of soaking the soiled fabric in an aqueous composition comprising a lipase, a lipase activator, and a conventional soap or detergent compound at a temperature of from about 40° to about 160°F for a period of from at least about 30 minutes. The soaking time depends on the load of triglyceride stain on the fabric, the enzyme concentration employed, the soaking temperature, the type of fabric and the use. Such considerations are well within the discretion of the routineer. In the second step of the process, the fabrics are cleansed in standard fashion using an aqueous soap or detergent solution.

During the soaking period, the triglycerides are degraded into diglycerides, monoglycerides, and/or glycerin and free fatty acids which are readily removed from the fabric in the subsequent laundering step. Although not wishing to be bound by theory, it is believed that the lipase activators of the present invention enhance the degradation of triglycerides by emulsifying the fatty acids produced, thereby preventing the formation of fatty acid mineral salts which might otherwise interfere with the ester-water interface believed necessary fo lipase hydrolysis (cf. Wills, *Bio. Chem. J.*, 60, 529 (1955)).

The lipases employed in this invention are those which exhibit lipolytic activity under the conditions of temperature and pH normally encountered in laundry situations. The lipases suitable herein are those which are characterized by sufficient lipolytic activity at a soaking temperature of about 40° to 160°F in a pH range of from 6 to 11 to alter, presumably by cleavage of ester bonds, or otherwise render more easily removable, the triglycerides found in oily stains normally encountered in a laundry situation.

Lipases suitable for use herein include those of animal, plant, and microbiological origin. Although only a few studies on lipase distribution in plants have been conducted, suitable lipase enzymes are present in cambium, bark, and in plant roots. In addition, lipases have been found in the seeds of fruit, oil palm, lettuce, rice bran, barley and malt, wheat, oats and oat flour, cotton, tung kernels, corn, millet, coconuts, walnuts, fusarium, cannabis and cucurbito.

Suitable lipases are also found in many strains of bacateria and fungi. For example, lipases suitable for use herein can be derived from Pseudomonas, Aspergillus, Pneumococcus, Staphylococcus, and Staphylococcus Toxins, Mycobacterium Tuberculosis, Mycotorula Lipolytica, and Sclerotinia, microorganisms.

Suitable animal lipases are found in the body fluids and organs of many species. Most organs of mammals contain lipases, but in addition, the enzymes are found in several digestive juices as well as in pancreatic juice. A preferred class of animal lipase herein is the pancreatic lipase.

Specific examples of the commercially-available lipase enzymes, suitable for use herein, the pH ranges of their optimum activity, and the source appear in Table I. Of course it is preferred to use a given lipase with its range of optimum activity.

TABLE I

| *Lipase | pH Range of Lipolytic Activity | Source |
|---|---|---|
| Remyzyme PL-600 | 7–11 | Pancreatic Juice |
| Astra | 7–10 | Microbial |
| Nacase | 7–9 | Microbial |
| Lipase YL | 7–9 | Microbial |
| Wallerstein AW | 7–9 | Fungal |
| Amano M-AP | 6–8 | Fungal |
| Meito MY-30 | 6–8 | Fungal |
| Amano CE | 8–10 | Microbial |
| Amano CE-50 | 7–10 | Microbial |
| Amano AP-6 | 6–8 | Fungal |
| Takeda 1969-4-9 | 6–8 | Microbial |

*Designated by commercial source

The lipases preferred for use herein are Amano CE, Amano M-AP, Takeda 1969-4-9, and Meito MY-30.

The concentration of lipase employed in the present compositions is an amount sufficient to degrade, or otherwise alter, triglyceride stains, during the soaking step of the instant processes, to ease their removal. While the concentrations employed are dependent upon the particular enzyme used and the conditions of solution, such as pH, temperature, and period of the presoak, normally, concentrations in the range of from about 0.01 to about 7.0% and preferably from about 0.02 to about 4.0%, are employed. Pre-soak compositions having a lipase component within this range result in normally useful concentrations of lipase in solution. The use of lipase below about 1 ppm, even at maximum concentrations, tends to require extended soaking periods, while the use of lipase at above about 100 ppm provides little additional benefit and is therefore economically wasteful.

The amount of lipase employed herein is somewhat dependent upon the activity level of the enzymes. Preferred herein are enzymes having an activity of from 10,000 to 20,000 units per gram (u/g) as determined by the liberation of fatty acid from triglyceride substrates under the conditions described more fully in the *Report of the Enzyme Committee*, International Biochemical Union 7-11 (1963).

The lipase activators suitable for use in the present invention are members selected from the group consisting of naphthalene sulfonates, certain polyoxyalkylenes of ethylenediamine, and certain acylamino acid salts.

The naphthalene sulfonates suitable for use herein include both the alpha and beta sulfonated naphthalenes. Such salts are commercially available wetting agents marketed by, for example, American Cyanamid Company. The preferred salts of naphthalene sulfonate include the alkali metal, ammonium, and substituted ammonium salts. Various non-limiting examples of suitable alkali metal salts include sodium isopropylnaphthalene sulfonate, potassium methylnaphthalene sulfonate, cesium butylnaphthalene sulfonate, and rubidium naphthalene sulfonate. Various non-limiting examples of suitable ammonium salts include ammonium naphthalene sulfonate and ammonium alkylnaphthalene sulfonates. The substituted water-soluble ammonium salts of napthalene sulfonate include lower alkyl, alkanol, and aryl ammonium salts such as tetramethylammonium naphthalene sulfonate, diethanolammonium isopropylnaphthalene sulfonate, phenylammonium methylnaphthalene sulfonate, triethanolammonium butylnaphthalene sulfonate, and quinolylammonium naphthalene sulfonate. The most preferred naphthalene sulfonate suitable for use herein is sodium isopropylnaphthalene sulfonate marketed by American Cynamid Company as Aerosol OS.

The polyoxyalkylene derivatives of ethylenediamine suitable for use herein are prepared by the sequential addition of ethylene and propylene oxides to ethylenediamine according to known procedures, and are commercially available, for example, from Wyandotte Chemicals Corporation under the tradename "Tetronics". Various suitable tetronics are thoroughly discussed in Wyandotte Chemicals Technical Bulletin, "Technical Data on Tetronic Series Nonionic Surfactants (1968)", incorporated herein by reference, and include for example Tetronics 501, 1104, 1301, 1302, 1501, 1502, 504, 701, 702, 704, 901, 904, 1101, and 1102. The most preferred polyoxyalkylene derivative of ethylenediamine suitable for use herein is Tetronic 701, wherein the poly(oxypropylene) hydrotrope has a typical molecular weight in the range of 2501 to 3000 and the poly(oxyethylene) hydrophil has a weight percentage of about 10%.

The acylamino acid salts suitable for use herein can be prepared by standard procedures. Non-limiting examples of suitable acylamino acid salts include N-capproyl-glycine, sodium salt; N-stearoyl-glycine, ammonium salt; N-palmityl glycine, methanolammonium salt; N-undecanoyl-1-alanine, potassium salt; N-lauroyl-d-alanine, tetramethylammonium salt; N-myristyl-1-alanine, naphthylammonium salt; N-margaroyl-d-valine, lithium salt; N-cerotyl-1-valine, ammonium salt; N-heneicosanoyl-1-valine, dimethylammonium salt; N-lauroyl-1-leucine, sodium salt; N-arachidyl-d-leucine, di-pyridylammonium salt; N-tridecanoyl-1-leucine, quinoylammonium salt; N-pelargonyl-1-isoleucine, cesium salt; N-pentadecanoyl-d-isoleucine, phenanthrylammonium salt; N-behenyl-1-isoleucine, ethanolammonium salt; N-tetracosanoyl-1-serine, rubidinum salt; N-pelargonyl-1-serine-2-hydroxypropyl, ammonium salt; N-enanthyl-d-serine, bis-(tetraoctylammonium) salt; N-nonadecanoyl-1-threonine, phenylammonium salt; N-cerotry-d-threonine, ammonium salt; and N-lauroyl-1-threonine, trimethyldodecylammonium salt. The most preferred acylamino acid salt is N-lauroyl-1-leucine, sodium salt.

Conventional enzyme-compatible surfactants can optionally be employed in the soaking step of the instant process. For example, soaps, i.e., the water-soluble salts, especially the alkali metal salts, of fatty acids containing from about 10 to about 22 carbon atoms can optionally be present with the lipase and activator in the soaking step. Likewise, synthetic detergent compounds, such as those disclosed in U.S. Pat. No. 3,308,067 issued Mar. 7, 1967, incorporated herein by reference, can be present in the soaking step.

Compositions comprising, in addition to lipase enzymes and lipase activators, a conventional surfactant system, as detailed above, are preferred for use herein.

Various materials such as sequestrants, builder salts and the like can likewise be co-present with the lipase and lipase activator in the soaking step. For example, the water-soluble salts of the polyphosphates, phosphates, tripolyphosphates, nitrilotriacetates, ethylenediaminetetracetates, carbonates, etc., can optionally be used in conjunction with the activator and lipase in the soaking step of the instant process. Specific examples of such sequestrants and builders include the phosphate, carbonate, etc., salts disclosed hereinafter. All such materials are compatible with the lipase enzymes herein.

The pH of the soaking step can be maintained at a particular and desired level by the incorporation of a buffering agent. The soaking step will normally be effected at a pH of from 6 to 11, and buffering agents can be employed to regulate pH within said range, especially the preferred range of 8 to 10, so as to maximize the activity of the lipase employed. Preferred buffers for use herein are sodium tetraborate decahydrate combined with boric acid, which maintains an acid-base balance within a pH range corresponding to the optimum lipolytic activity level. Other suitable buffers can be employed to maintain a desired pH range depending on the particular lipase used in the presoak. Exampls of other buffers include monosodium phosphate, and sodium acid pyrophosphate and mixtures thereof.

Other minor ingredients can also be present in the soaking compositions. Soil-suspending agents such as sodium carboxymethylcellulose, optical brighteners, dyes, germicidal agents, suds depressants, and suds boosters can each be added in amounts up to about 10% by weight of the composition.

The soaking step of the process of the present invention can be carried out in any of the types of containers normally found in the household. Thus, the soaking step can be conducted in basins, tubs, washtubs, buckets, pails or the like so as to effect the soil- and stain-removing function of the combined employment of lipase and activator. A preferred method of effecting the soaking operation involves the use of the laundry tub or basin of a conventional home washing machine. The conduct of the soaking step in this fashion eliminates the need for removing the garments for a subsequent washing operation which will normally be effected in a washing machine. The soaking of the fabrics can be conducted with the aid of agitation. Such agitation is conveniently employed as a means of reducing the soaking time required to effect soil and stain removal.

The soaking operation can be conducted over a wide temperature range and in accordance with usual laundry soaking methods. The temperature should not be such as to cause inactivation or denaturation of the enzyme component. A temperature in the range of from 40° to 160°F is suitable from the standpoint of assuring substantial enzymatic activity. A preferred temperature is from 80° to 110°F.

The washing step which follows the presoaking step described hereinbefore is conducted in the presence of an organic detergent. Suitable detergents for employment in the washing step include, for example, any of the commercially-available heavy-duty laundry compositions or soap compositions commonly employed in home laundering. Detergent compositions will comprise a water-soluble organic synthetic detergent or soap and, preferably, a builder salt for enhanced cleaning properties. Examples of suitable detergent compounds which can be employed are those described hereinbefore and the alkali metal soaps, such as the sodium and potassium salts, of naturally occurring plant or animal esters (e.g., palm oil, coconut oil, babassu oil, soybean oil, castor oil, tallow, whale and fish oils, grease and lard, and mixtures thereof) or of synthetically produced fatty acids (e.g., rosin and those resin acids in tall oil) and/or of naphthenic acids.

Suitable builder salts will include alkali metal carbonates, borates, phosphates, polyphosphates, bicarbonates and silicates. Ammonium or substituted ammonium salts can also be used. Specific examples of such salts are sodium tripolyphosphate, sodium carbonate, sodium pyrophosphate, sodium bicarbonate, potassium tripolyphosphate, sodium hexametaphosphate, sodium sesquicarbonate, sodium mono- and diorthophosphate and potassium bicarbonate.

Examples of organic alkaline sequestrant and builder salts used alone or in admixture include alkali metal, ammonium or substituted ammonium, aminopolycarboxylates, e.g., sodium and potassium N-(2-hydroxyethyl) -ethylenediaminetriacetates, sodium and potassium nitrilotriacetates and sodium, potassium and triethanolammonium N-(2-hydroxyethyl)-nitrilo diacetates. Mixed salts of these polycarboxylates are also suitable. The alkali metal salts of phytic acid, e.g., sodium phytate are also suitable as organic alkaline sequestrant builder salts (see U.S. Pat. No. 2,739,942). The detergent and builder components will normally be employed in such amounts as to provide a ratio of builder salt to organic detergent of from about 1:1 to 10:1.

Following completion of the lipase- activator presoaking operation of the invention, the treated fabrics are laundered in a conventional manner with the aid of an effective amount of a laundry composition comprising a detergent surfactant and optional builder components as described. If desired, the laundry detergent component can be added to the aqueous presoaking bath so as to conveniently effect the two-step process of the present invention. The detergent washing step, which involves the use of conventional laundry detergent compositions in amounts customarily employed in home laundering operations, facilitates the removal of the fragmented products resulting from the fat-splitting properties of the lipase employed in the soaking step. Thus, the hydrolyzed products of the soaking, which include glycerine and fatty acids, are removed from the treated fabrics to provide improved cleaning effects.

Fabrics treated in accordance with the presoaking and washing steps of the present invention are rinsed in the usual fashion. The rinsing operation can be conveniently effected in a home washing machine as the usual rinsing operation which follows a conventional detergent wash. Following rinsing, the treated fabrics can be dried, ironed or folded as is customary in the laundry arts.

The process of the present invention is particularly efficacious in removing oily triglyceride soils and stains from polyester and polyester-containing fabric materials. Thus, the process can be employed to remove such triglyceride soils and stains from fabrics woven from polyester fibers or from fabrics which employ combinations of polyester fibers and other fibers (e.g., 65% polyester, 35% cotton blends). Examples of polyester fabrics are those woven or nonwoven materials fabricated from polyester fibers, the most common of which are copolymers of ethylene glycol and terephthalic acid. Such fabrics are commercially available under a number of trade names, e.g., Dacron, Fortrel, Kodel and Blue C Polyester.

The following example illustrates a laundry pre-soak composition containing lipase in combination with a lipase activator as hereinabove defined. The example is only by way of illustration and is not intended to be limiting of the compositions of the invention.

EXAMPLE I

Improved, low cost, laundry pre-soak compositions having the following formulas are prepared.

| Components | Formula |
|---|---|
| Sodium sulfate | 36% |
| Sodium carbonate | 15% |
| Sodium silicate | 15% |
| Linear dodecyl benzene sulfonate | 5% |
| Sodium tallow alkyl sulfonate | 2% |
| Amano M-AP | 2% |
| Aerosol OS* | 20% |
| Water | Balance |

*Sodium isopropylnaphthalene sulfonate

In the preceding composition, the Amano M-AP lipase is replaced by an equivalent amount of Amano CE, Takeda 1969-4-9, Meito MY-30, to form comparable pre-soak compositions.

In the above composition, the Aerosol OS is replaced by an equivalent amount of Tetronic 701 and N-lauroyl-1-leucine, to form comparable pre-soak compositions.

The following examples illustrate the process of this invention for removing triglycerides from fabrics employing a lipase-activator presoaking step followed by laundering in standard fashion. The examples are only by way of illustration and are not intended to be limiting of the process of the invention.

EXAMPLE II

Eight pounds of a mixed load of cotton, Dacron, and polyester/cotton blend fabrics stained with triolein are immersed in 8 gallons of water containing 0.05% by weight of sodium isopropylnaphthalene sulfonate (Aerosol OS) and 50 ppm Amano M-AP lipolytic enzyme at pH 8. The fabrics are allowed to soak for a period of 3 hours at 70°F. Following the soaking operation, the fabrics are placed in a standard, top-loading automatic washing machine containing 12 gallons of water and one cup of a commercial, spray-dried, built laundry detergent. The fabrics are laundered in standard fashion at a water temperature of 100°F and dried.

Fabrics treated in the foregoing manner have substantially more of the triglyceride stain removed than do fabrics pre-soaked in Amano M-AP, alone, or in Aerosol OS, alone, prior to laundering.

In the above process, the Amano M-AP enzyme is replaced by an equivalent amount of the following lipase enzymes: Astra, Nagase, Lipase YL, Wallerstein AW, Meito MY-30, Amano CE, Amano CE-50, Amano AP-6 and Takeda 1969-4-9, respectively, and equivalent results are secured in that improved removal of triolein stain is secured.

In the foregoing procedure the Aerosol OS is replaced by an equivalent aount of a polyoxyalkylene derivative of ethylenediamine wherein the poly(oxypropylene) hydrotrope has a typical molecular weight in the range of 2501 to 3000 and the poly (oxyethylene) hydrophil has a weight percentage of about 10% (Tetronic 701) and N-lauroyl-1-leucine sodium salt and equivalent removal of the triglyceride stains is secured.

EXAMPLE III

Dacron fabric swatches soiled with commercial French salad dressing (5% by weight) are cleansed as follows: 3 pounds of the swatches are immersed in 3 gallons of water containing 50 ppm of Amano CE-50 lipase and 0.005% by weight of Tetronic 701 (pH 8.5). The heavily soiled Dacron swatches are allowed to stand in the soaking liquor at 100°F for 15 hours with occasional agitation. Following the presoaking, the fabrics are removed from the soaking solution and laundered in standard fashion with a commercial, built anionic detergent composition employed in a conventional automatic home washing machine. The detergent composition is used at a concentration of 1000 ppm in water at temperature of 110°F to launder the pre-soaked Dacron fabrics.

The mixed triglyceride stains present in the salad dressing are substantially removed from the Dacron swatches pre-soaked and laundered in the foregoing manner.

As can be seen from the foregoing, the process of this invention for removing triglycerides from fabrics, especially polyester and polyester/cotton blends, can be successfully carried out using all manner of lipase enzymes and specific lipase activators as herein detailed. Lipase enzymes from microbial sources, especially Amano M-AP, are preferred in the processes herein.

What is claimed is:

1. A laundry pre-soak composition for improved triglyceride stain removal comprising from about 0.01 to about 7.0% by weight of a lipase and from about 0.1 to about 70% by weight of a water-soluble lipase activator selected from the alkali metal salts and ammonium salts of isopropylnaphthalene sulfonate, methylnaphthalene sulfonate, or butylnaphthalene sulfonate.

2. A composition according to claim 1 wherein the lipase enzyme is selected from the group consisting of Amano CE, Amano M-AP, Takeda 1969-4-9, and Meito MY-30.

3. A composition according to claim 1 comprising, in addition to lipase enzyme and a lipase activator, a surfactant.

4. A process for removing triglycerides from fabrics, comprising: soaking the fabric in the aqueous composition of claim 1 for a period of from at least 30 minutes; and thereafter laundering in an aqueous solution of soap or synthetic detergent composition.

5. A process according to claim 4 wherein the lipase enzyme is a member selected from the group consisting of Amano CE, Amano M-AP, Takeda 1969-4-9, and Meito MY-30.

6. A process according to claim 4 wherein the lipase enzyme is Amano M-AP.

* * * * *